US008732881B2

(12) United States Patent
Shu

(10) Patent No.: US 8,732,881 B2
(45) Date of Patent: May 27, 2014

(54) METHOD FOR MANUFACTURING DETACHABLE ZIPPER SHOE

(76) Inventor: Yung Yin Shu, Yuanlin Township, Changhua County (TW)

( * ) Notice: Subject to any disclaimer, the term of this patent is extended or adjusted under 35 U.S.C. 154(b) by 148 days.

(21) Appl. No.: 13/255,617

(22) PCT Filed: Feb. 2, 2010

(86) PCT No.: PCT/CN2010/070474
§ 371 (c)(1),
(2), (4) Date: Sep. 9, 2011

(87) PCT Pub. No.: WO2011/094928
PCT Pub. Date: Aug. 11, 2011

(65) Prior Publication Data
US 2012/0324656 A1 Dec. 27, 2012

(51) Int. Cl.
*A43B 3/24* (2006.01)

(52) U.S. Cl.
USPC ..... 12/142 R; 12/142 T; 36/15

(58) Field of Classification Search
USPC ..... 12/142 R, 142 T, 142 RS; 36/15, 100, 36/101
See application file for complete search history.

(56) References Cited

U.S. PATENT DOCUMENTS

| | | | | |
|---|---|---|---|---|
| 4,103,440 | A * | 8/1978 | Lawrence | 36/101 |
| 4,745,693 | A * | 5/1988 | Brown | 36/101 |
| 5,727,334 | A * | 3/1998 | Cougar | 36/15 |
| 5,983,528 | A * | 11/1999 | Hartung | 36/15 |
| 7,669,352 | B2 * | 3/2010 | Stefani | 36/101 |
| 7,797,857 | B2 * | 9/2010 | Mattia | 36/101 |
| 8,028,441 | B2 * | 10/2011 | Stefani | 36/100 |
| 2004/0093764 | A1 * | 5/2004 | Cheng | 36/100 |
| 2005/0229435 | A1 * | 10/2005 | Shih | 36/101 |
| 2006/0032084 | A1 * | 2/2006 | Pang et al. | 36/7.1 R |
| 2008/0092408 | A1 * | 4/2008 | Yeung | 36/101 |
| 2008/0235992 | A1 * | 10/2008 | Stefani | 36/101 |
| 2011/0302803 | A1 * | 12/2011 | Kim | 36/23 |

* cited by examiner

*Primary Examiner* — Marie Bays

(57) ABSTRACT

Method for manufacturing detachable zipper shoe comprises steps of: I. preparing cardboards: 1) structuring a shoe last, 2) making cardboards, and 3) drawing arrays of marks; II. making a vamp: 1) making a first cutting die, 2) cutting, 3) drawing marks on the vamp, 4) combining the vamp, and 5) combining the vamp and an upper zipper; III. making an outsole: 1) forming the outsole, and 2) combining the outsole and a lower zipper; IV. making an inner sole: 1) making a second cutting die, 2) cutting, and 3) combining the inner sole and the outsole; V. fixing the vamp. The method of the present invention adopts sets of marks predetermined on the vamp, the upper zipper, the lower zipper, the inner sole, and the outsole to be aligned with each other, so as to prevent the combination of the afore portions from displacement. Therefore, one single sole of the same size can cooperate with different types of vamps for satisfying a mass production of shoes.

10 Claims, 4 Drawing Sheets

METHOD FOR MANUFACTURING DETACHABLE ZIPPER SHOE

BACKGROUND OF THE INVENTION

1. Field of the Invention

The present invention relates to a method for making a shoe, especially to a method for manufacturing detachable zipper shoe.

2. Description of the Related Art

A detachable shoe with a vamp and a sole able to be zipped up has been shown in some patent documents several years ago. This detachable shoe allows the vamp and the sole of different types to be randomly arranged in pairs. Conveniently, consumers could simply purchase one sole for fitting different vamps. That is, consumers can have a wide choice on their shoes, and the cost for purchasing different pairs of shoes is accordingly lessened. Moreover, the vamp and the sole might be worn out differently. Herein, only the broken part has to be replaced, thereby preventing wastage.

However, it is uncommon to see this kind of detachable shoes in the market since in reality the detachable shoes are merely a concept that has not been executed. A basic requirement for the detachable shoes is that the upper zipper on the vamp has to be completely suited to the lower zipper on the sole, so that a single sole could be fitted to different vamps of the same size but of the different types. The basic requirement could be easily achieved while only a few detachable shoes are made. Nonetheless, if many detachable shoes are to be produced, the current technique for efficiently producing the detachable shoes is immature yet. Therefore, the existing detachable shoes need improvement, and the inventor endeavors to develop the usable method in accordance with the present invention.

SUMMARY OF THE INVENTION

The present invention is to provide a method that is able to efficiently and competently produce the detachable zipper shoes.

Afore Object is Achieved by Following Means:

Method for Manufacturing Detachable Zipper Shoe Comprises Steps of:

Preparing Cardboards:

1) structure a shoe last: the shoe last is structured in accordance with a design chart and a designate size of the detachable shoe;

2) make cardboards: vamp cardboards, an inner sole cardboard, and an outsole cardboard are made in accordance with the shoe last;

3) draw arrays of marks for orientation: respectively draw a plurality of marks aligned with each other on the vamp cardboards, an upper zipper, a lower zipper, the inner sole cardboard, and the outsole cardboard;

Making a Vamp:

1) make a first cutting die: the first cutting die for cutting the vamp is made in accordance with the vamp cardboards;

2) cut: vamp parts are cut out from an integral vamp material via the first cutting die;

3) draw vamp marks on the vamp: correspondingly draw a plurality of vamp marks on the vamp parts in accordance with the marks on the vamp cardboard, thereby drawing accordant sewing lines on each part of the vamp;

4) combine the vamp: combine every part of the vamp via the sewing lines for contributing to a complete vamp;

5) combine the vamp with the upper zipper: the complete vamp and the upper zipper are combined according to the vamp marks on the vamp and the marks on the upper zipper, thereby combining the vamp with the upper zipper;

Making an Outsole:

1) form the outsole: the outsole is shaped in accordance with the outsole cardboard, and outsole marks are drawn on the outsole cardboard after the outsole is shaped;

2) combine the outsole and the lower zipper: the outsole is combined to the lower zipper in accordance with the outsole marks and the marks on the lower zipper after the outsole is shaped;

Making an Inner Sole:

1) make a second cutting die: the second cutting die for cutting the inner sole is made in accordance with the inner sole cardboard;

2) cut: an inner sole material is cut out via the second cutting die, and inner sole marks are drawn on the inner sole cardboard so as to combine with the vamp;

3) combine the inner sole and the outsole: the inner sole is placed within a lining of the outsole, thereby allowing the inner sole and the outsole to be combined together by a cooperation of the outsole marks and the inner sole marks drawn on both of the inner sole and the outsole;

Fixing the Vamp:

the complete vamp and the complete outsole combined with the inner sole are zipped up, whereby the shoe last is slipped therein, and the vamp is further fixed through a cold vulcanizing and a hot vulcanizing; the shoe last is taken out after the vamp being fixed, and an insole is embedded into the vamp to complete a combination of an integral shoe and achieve a finished detachable shoe.

Preferably, the marks correspondingly drawn on the cardboards and the upper and the lower zippers are distributed on four sides relevant to a front side, a back side, a left side, and a right side of the shoe, or are distributed on six sides including not only the four sides but start points and terminal points of the zippers.

Preferably, the lower zipper and the outsole are combined via cementing; the outsole with the lower zipper and the inner sole are combined via a cold adhibiting method or vulcanization.

Preferably, before combining the vamp or the soles, a set of main zippers of different sizes are provided with several marks according to the cardboards; by means of said main zipper, while zipping up the lower zipper and a main upper zipper of a same size, the marks on the lower zipper are able to be drawn according to the main upper zipper; while zipping up the upper zipper and a main lower zipper of the main zipper of a same size, the marks on the upper zipper are able to be drawn according to the main lower zipper.

Method for manufacturing detachable zipper shoe comprises steps of:

Preparing Cardboards:

1) structure a shoe last: the shoe last is structured in accordance with a design chart and a designate size of the detachable shoe;

2) make cardboards: vamp cardboards, an inner sole cardboard, and an outsole cardboard are made in accordance with the shoe last;

3) draw sets of marks for orientation: respectively draw a plurality of marks aligned with each other the vamp cardboards, an upper zipper, a lower zipper, the inner sole cardboard, and the outsole cardboard;

Making a Vamp:

1) make a first cutting die: the first cutting die for cutting the vamp is made in accordance with the vamp cardboards;

2) cut: vamp parts are cut out from an integral vamp material via the first cutting die;

3) draw vamp marks on the vamp: correspondingly draw a plurality of vamp marks on the vamp parts in accordance with the marks on the vamp cardboard, thereby drawing accordant sewing lines on each part of the vamp;

4) combine the vamp: combine every part of the vamp via the sewing lines for contributing to a complete vamp;

Making an Inner Sole:

1) make a second cutting die: the second cutting die for cutting the inner sole is made in accordance with the inner sole cardboard;

2) cut: an inner sole material is cut out via the second cutting die, and inner sole marks are drawn according to the inner sole cardboard so as to combine with the vamp for combining with the vamp;

Making an Outsole:

outsole marks are correspondingly drawn inside the outsole in time of making the outsole in a forming die, and after the outsole is shaped, a step for shaping said vamp ensues;

combining the vamp, the inner sole, and the zippers:

1) combine the vamp and the upper zipper: the vamp marks on the vamp and the marks on the upper zipper are correspondingly disposed, allowing the vamp and the upper zipper to be combined;

2) combine the inner sole and the lower zipper: before combining the inner sole to the lower zipper, a piece of leather that is of high density is provided for joining to the lower zipper; after joining the leather to the lower zipper, the lower zipper is sewn to and the inner sole via aligning the inner sole marks on the inner sole with the marks on the lower zipper;

3) combine the vamp and the inner sole: the vamp and the inner sole are combined through zipping up the upper zipper and the lower zipper;

Fixing the Vamp and Combining to the Outsole:

the vamp and the inner sole are combined, thereby slipping the shoe last to further fix the vamp through a cold vulcanizing and a hot vulcanizing; the fixed vamp is further combined to the outsole for achieving a complete detachable shoe.

Preferably, in making the vamp, fixing marks are drawn on the first cutting die in accordance with the marks on the vamp cardboards, thereby allowing the vamp marks to be drawn on each part of the vamp according to the fixing marks on the first cutting die while cutting.

Preferably, the marks correspondingly drawn on the cardboards and the upper and the lower zippers are distributed on four sides relevant to a front side, a back side, a left side, and a right side of the shoe, or are distributed on six sides including not only the four sides but start points and terminal points of the zippers.

Preferably, the outsole combined with the zippers and the inner sole are further joined via a cold adhibiting method or vulcanization.

Preferably, the vamp is formed in accordance with a main plate that is reversely made by the vamp formed via a combination of the vamp cardboards and drawn with the vamp marks.

Preferably, the upper zipper and the lower zipper are formed in accordance with a main zipper drawn with several marks corresponding to the vamp marks on the vamp; the main zipper is built according to marks on a main plate, thereby allowing several main zippers of different sizes to be formed; while zipping up the lower zipper and a main upper zipper of a same size, the marks on the lower zipper are able to be drawn according to the main upper zipper; while zipping up the upper zipper and a main lower zipper of the main zipper of a same size, the marks on the upper zipper are able to be drawn according to the main lower zipper.

Accordingly, the present invention utilizes a plurality of marks for properly aligning the vamp, the upper zipper, the lower zipper, the inner sole, and the outsole to avoid displacement. Therefore, a single sole could be fitted to vamps of different types but of the same size. Favorably, the method helps efficient productivity.

DETAILED DESCRIPTION OF THE PREFERRED EMBODIMENTS

Following embodiments are depicted along with Figures for reference.

Figure 1:
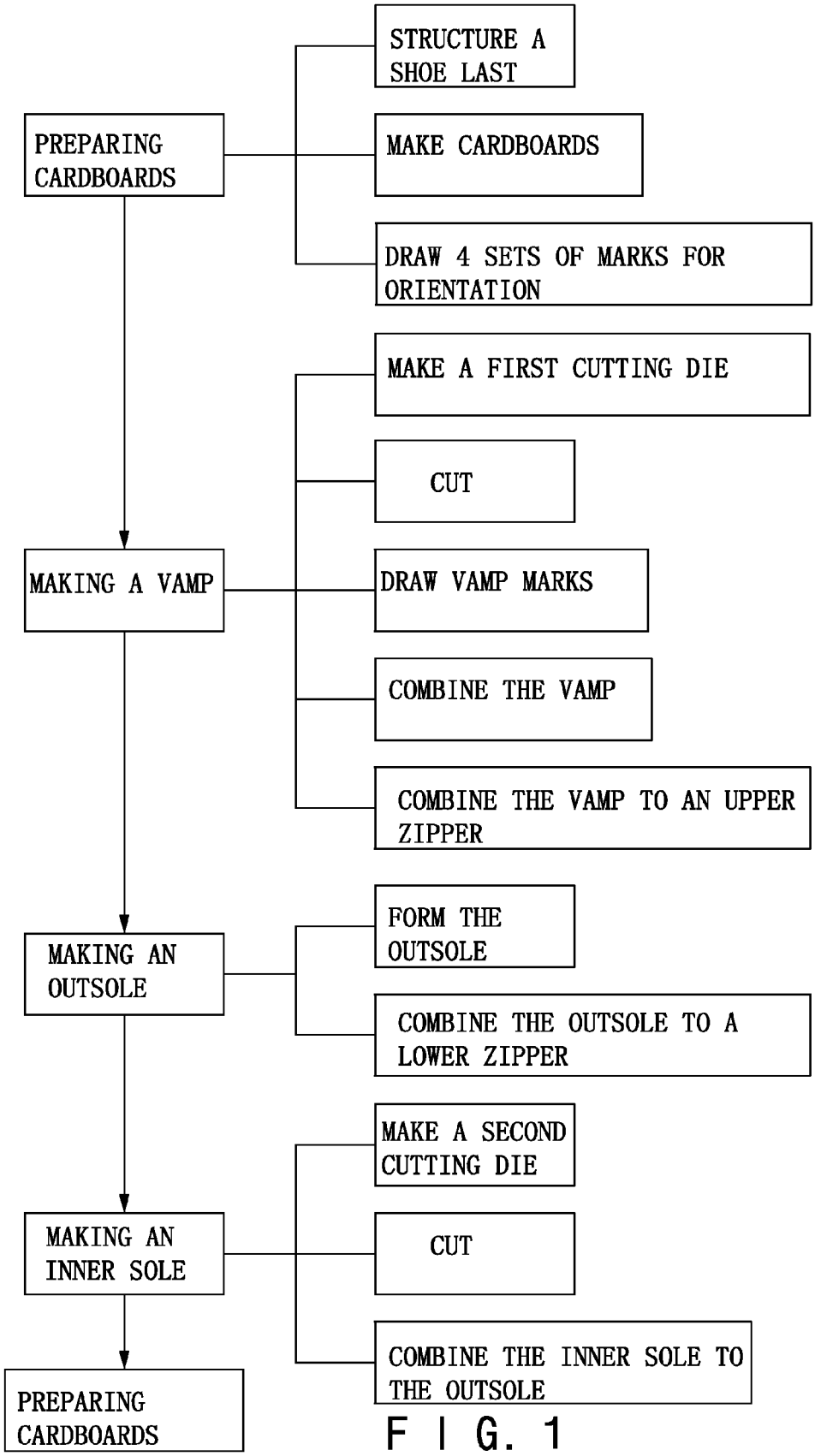
FIG. 1 is a flowchart showing a first preferred embodiment of the present invention.
Figure 2:
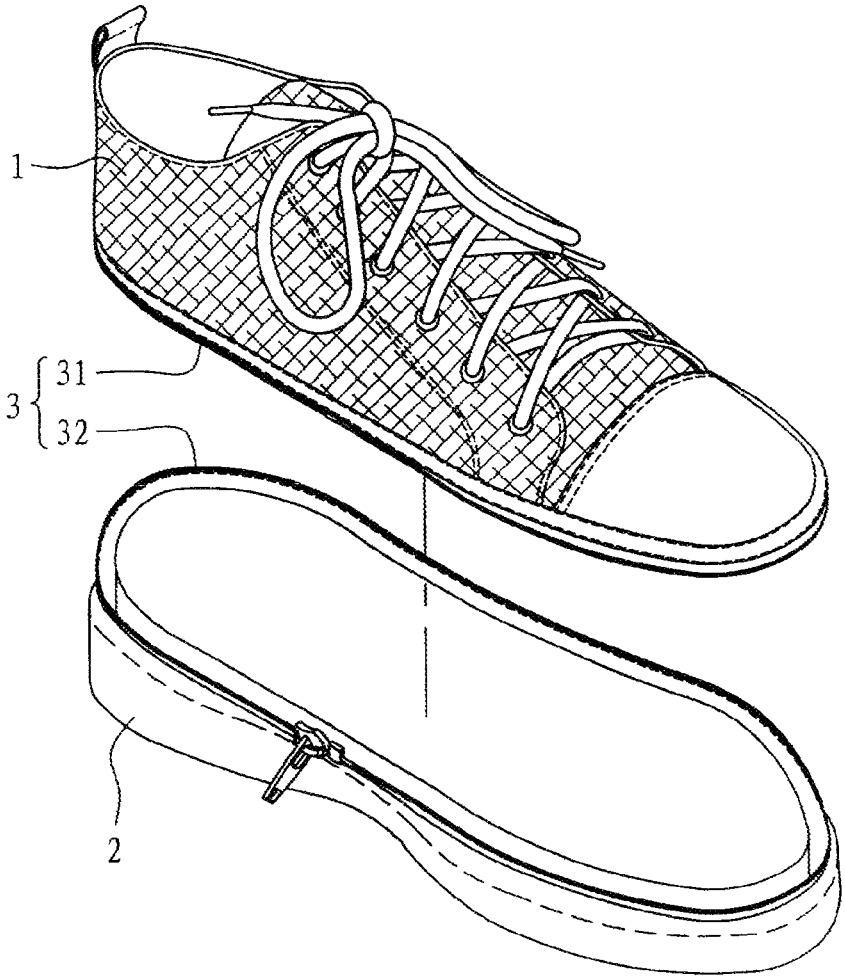
FIG. 2 is a schematic view showing a detachable shoe made by the method in accordance with the first preferred embodiment.

A detachable zipper shoe as shown in FIG. 2 comprises a vamp 1, a sole 2, and zippers 3. The zippers 3 include an upper zipper 31 connected to the vamp 1 and a lower zipper 32 connected to the sole 2. Commonly, several parts 11 are sewed to form the vamp 1. The detachable zipper shoe made in accordance with the method of the present invention is shown by the flowchart in FIG. 1, comprising steps of:

I. Preparing Cardboards:

1) structure a shoe last: the shoe last is structured in accordance with a design chart and a designate size of the detachable shoe;

2) make cardboards: vamp cardboards, an inner sole cardboard, and an outsole cardboard are made in accordance with the shoe last;

3) draw four sets of marks for orientation: respectively draw four marks aligned with each other on the vamp cardboards, an upper zipper, a lower zipper, the inner sole cardboard, and the outsole cardboard, thereby avoiding displacement; wherein, afore marks are distributed on a front side, a back side, a left side, and a right side of the shoe;

II. Making a Vamp:

1) make a first cutting die: the first cutting die for cutting the vamp is made in accordance with the vamp cardboards;

2) cut: vamp parts are cut out from an integral vamp material via the first cutting die;

3) draw vamp marks on the vamp: correspondingly draw four vamp marks on the vamp parts in accordance with the four marks on the vamp cardboard, thereby drawing accordant sewing lines on each part of the vamp;

4) combine the vamp: combine every part of the vamp via the sewing lines for contributing to a complete vamp; the vamp should be carefully sewed along the sewing lines; otherwise the finished vamp would be resulted in the displacement and unable to be properly combined with the upper zipper or the sole;

5) combine the vamp with the upper zipper: the complete vamp and the upper zipper are combined according to the four vamp marks on the vamp and the four marks on the upper zipper, thereby combining the vamp with the upper zipper; afore marks have to be carefully aligned;

III. Making an Outsole:

1) form the outsole: the outsole is shaped in accordance with the outsole cardboard, and four outsole marks are drawn on the outsole cardboard after the outsole is shaped;

2) combine the outsole and the lower zipper: the shaped outsole is rinsed by a removing liquid, applied with cement, and applied with cement again after being dried; the lower zipper is equally rinsed by a removing liquid, applied with cement, and applied with cement again after being dried; accordingly, the outsole is combined to the lower zipper in accordance with the four outsole marks and the four marks on the lower zipper, thereby sewing appropriate lines on the outsole;

IV. Making an Inner Sole:

1) make a second cutting die: the second cutting die for cutting the inner sole is made in accordance with the inner sole cardboard;

2) cut: an inner sole material is cut out via the second cutting die, and four inner sole marks are drawn according to the inner sole cardboard so as to combine with the vamp;

3) combine the inner sole and the outsole: the inner sole is placed within a lining of the outsole, thereby allowing the inner sole and the outsole to be combined together by a cooperation of the four outsole marks and the four inner sole marks drawn on both of the inner soles and the outsole through a cold adhibiting method or vulcanization;

V. Fixing the Vamp:

the complete vamp and the complete outsole combined with the inner sole are zipped up through the zippers, whereby the shoe last is slipped therein, and the vamp is further fixed through a cold vulcanizing and a hot vulcanizing; the shoe last is taken out after the vamp being fixed, and an insole is embedded into the vamp to complete a combination of an integral shoe and to achieve a finished detachable shoe as shown in FIG. 2.

Accordingly, the vamp has to be combined and fixed, thereby detaching from the outsole so as to execute a repeating combining and fixing. Favorably, each vamp could be properly combined with the outsole.

Aforesaid method for making a detachable shoe utilizes four sets of marks distributed on the front side, the back side, the left side, and the right side of the shoe to combine the vamp, the zippers, the inner sole, and the outsole by means of the alignments of the marks. Therefore, the method avoids displacement on the shoe, so that a single sole could cooperate with vamps of different types but of the same size, which efficiently improves the productivity.

Nevertheless, afore method still has shortcomings as follows:

1) The shoe is in fact instable. Namely, the shoe is still subject to displacement. As a result, the toe of the shoe is easily unsymmetrical, so the method needs amendment.

2) The outsole and the lower zipper that are directly contact are subject to departure. This is because the outsole adopts rubber whose density is kind of low, and the lower zipper adopts common cloth or nylon. Obviously, the adopted materials are unsuited to each other. While the outsole and the lower zipper are sewn by sewing lines, perforations on the outsole easily start spoiling, which affects the using life of the shoe. While the outsole and the lower zipper are combined by cement, the different materials readily render the cement to come off, thereby equally affecting the using life of the shoe.

3) When the vamp is shaped, the vamp and the sole have to be heated for further shaping so as to ensure that they both could be combined through the upper zipper and the lower zipper. However, the shaped rubber outsole is unsuited for a further heating since the high temperature may affect the property of the rubber. As a result, in order to avoid affecting the quality of the outsole, the temperature has to be appropriately controlled in time of shaping the outsole. However, the insufficient temperature may result in a bad outsole or a distorted outsole. Even worse, the using life of this kind of outsole is short.

Figure 3:
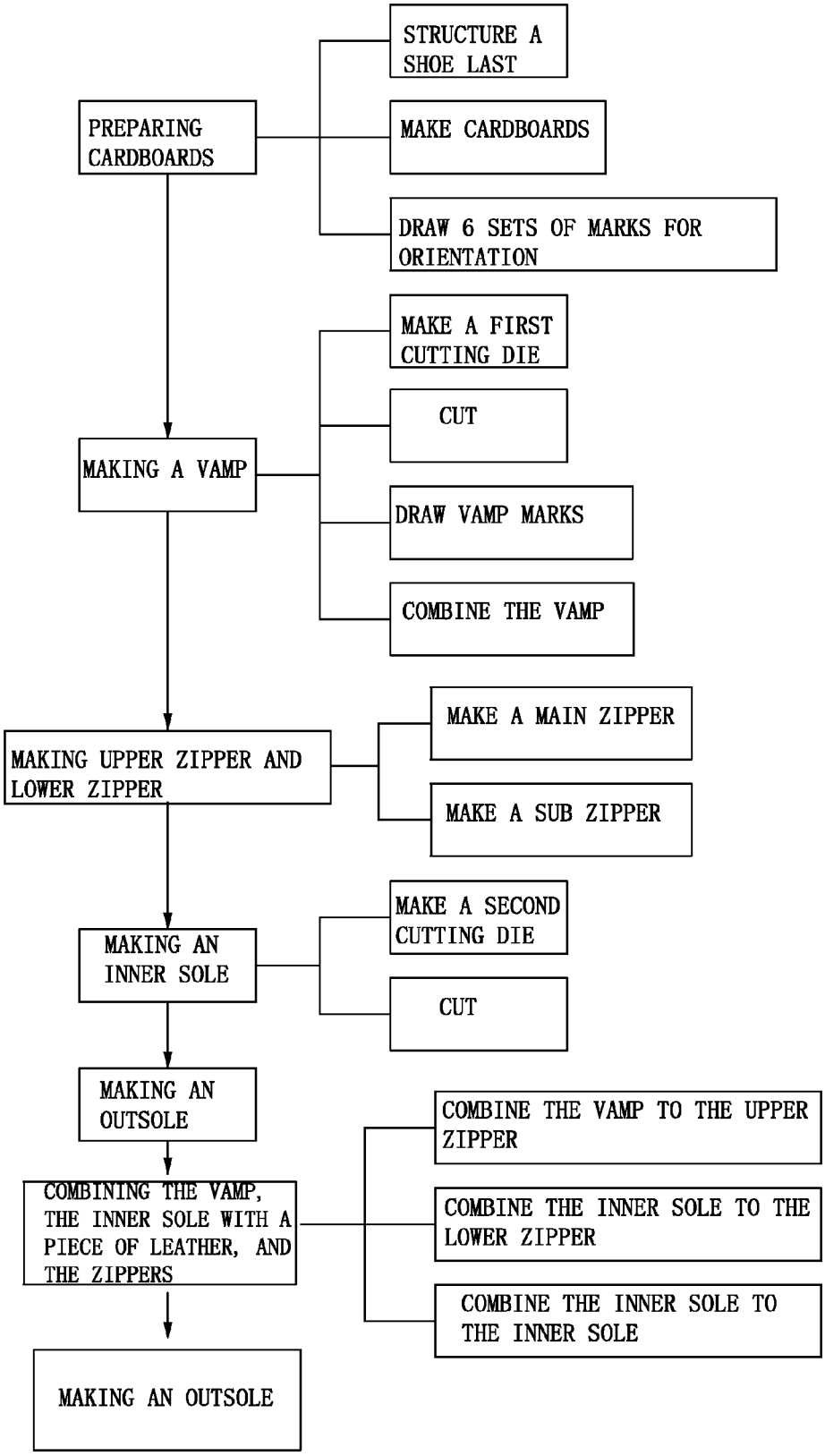
FIG. 3 is a flowchart showing a second preferred embodiment of the present invention.
Figure 4:
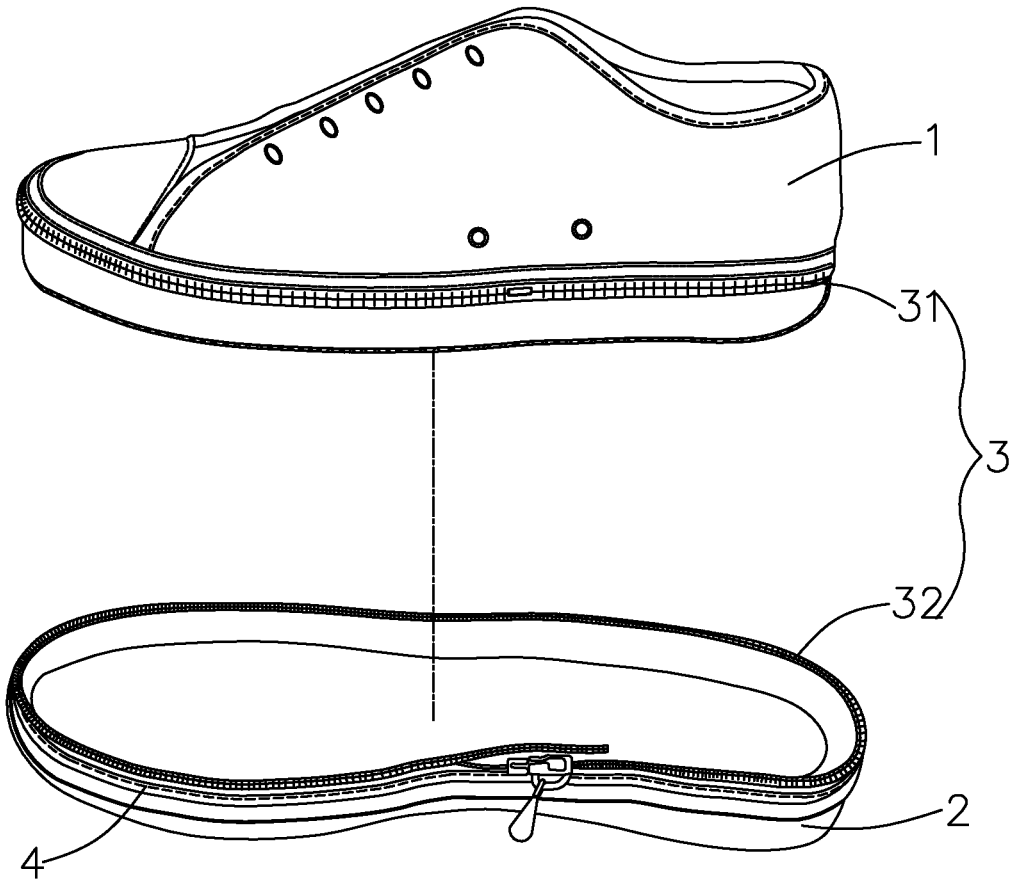
FIG. 4 is a schematic view showing a detachable shoe made by the method in accordance with the second preferred embodiment.

FIG. 3 shows a second preferred embodiment of the present invention. The detachable zipper shoe is shown in FIG. 4 comprising a vamp 1, a sole 2, and zippers 3 for connecting afore vamp 1 and sole 2. The zippers 3 include an upper zipper 31 connected to the vamp 1, and a lower zipper 32 connected to the sole 2. Wherein, the sole 2 and the lower zipper 32 are connected through a piece of leather 4. Several parts 11 are sewn to form the vamp 1.

A method for manufacturing detachable zipper shoe as shown in FIG. 3 comprises steps of:

I. Preparing Cardboards:

1) structure a shoe last: the shoe last is structured in accordance with a design chart and a designate size of the detachable shoe;

2) make cardboards: vamp cardboards, an inner sole cardboard, and an outsole cardboard are made in accordance with the shoe last;

3) draw six sets of marks for orientation: respectively draw six marks aligned with each other on the vamp cardboards, an upper zipper, a lower zipper, the inner sole cardboard, and the outsole cardboard; wherein, the marks are distributed on a front side, a back side, a left side, and a right side of the shoe, or are distributed on six sides including not only the four sides but start points and terminal points of the zippers;

II. Making a Vamp:

1) make a first cutting die: the first cutting die for cutting the vamp is made in accordance with the vamp cardboards, thereby drawing six fixing marks on the first cutting die;

2) cut: vamp parts are cut out from an integral vamp material via the first cutting die;

3) draw vamp marks on the vamp: correspondingly drawing six vamp marks on the vamp parts in accordance with the marks on the vamp cardboard, thereby drawing accordant sewing lines on each part of the vamp;

4) combine the vamp: combine every part of the vamp via the sewing lines for contributing to a complete vamp; otherwise the vamp would be resulted in the displacement and unable to be properly combined with the upper zipper or the sole;

III. Making a Main Plate and a Main Zipper:

1) make the main plate: in order to reduce the unavoidable inaccuracy between the design chart and the vamp, the present invention takes the vamp that is drawn by six marks and combined in accordance with afore method to repeatingly sketch the main plate provided with each part of the vamp; therefore, the main plate could be served as a model for making further vamp;

2) make the main zipper: a zipper is combined to the vamp that is formed in accordance with afore method, thereby drawing several marks on the zipper aligned with the vamp marks on the vamp; afore marks on the zipper could be alternatively drawn aligning with the marks on the main plate; accordingly, a set of main zippers that each of the zipper include six marks thereon are produced;

3) make a sub zipper: aforesaid main zipper allows its lower zipper and other upper zippers of the same size to previously zip up, thereby drawing proper marks in accordance with the main zipper on the lower zipper; equally, aforesaid main zipper also allows its upper zipper and other lower zippers of the same size to previously zip up, thereby drawing proper marks in accordance with the main zipper on the upper zipper; therefore, all the upper zippers and the lower zippers are respectively suited to the main zipper and fitted to each other; if the procedure that the upper zippers and the lower zippers should be respectively zipped up to the main zipper is omitted, large inaccuracy may be resulted on the zippers, which lets the lower zipper and the upper zipper of the same size be unsuited to each other.

IV. Making an Inner Sole:

1) make a second cutting die: the second cutting die for cutting the inner sole is made in accordance with the inner sole cardboard;

2) cut: an inner sole material is cut out via the second cutting die, and six inner sole marks are drawn according to the inner sole cardboard for combining with the vamp;

V. Making the Outsole:

the outsole is commonly made of rubber and shaped via a forming die; other suited material could be freely adopted to make the outsole; herein, six outsole marks are correspondingly drawn inside the outsole in time of making the outsole in the forming die; after the outsole is formed, a removing liquid is applied to rinse the outsole, and then the rinsed outsole is dried for cement; while the applied cement is dried on the outsole, a further cement should be applied thereto so as to achieve a complete forming;

VI. Combining the Vamp, the Inner Sole, and the Zipper:

1) combine the vamp and the upper zipper: the six vamp marks on the vamp and the six marks on the upper zipper are correspondingly disposed, allowing the vamp and the upper zipper to be combined;

2) combine the inner sole and the lower zipper: before combining the inner sole to the lower zipper, a piece of leather 4 that is of high density is provided; herein, the leather and the lower zipper are previously glued or sewn, so that the composite lower zipper could be further sewn to the inner sole; wherein, the six inner sole marks on the inner sole have to be aligned with the six marks on the lower zipper;

3) combine the vamp and the inner sole: the vamp and the inner sole are combined through zipping up the upper zipper and the lower zipper;

VII. Fixing the Vamp and Combining to the Outsole:

the vamp and the inner sole are combined, thereby slipping the shoe last to further fix the vamp through a cold and hot vulcanization; the fixed vamp is further combined to the outsole via the cold adhibiting method or the vulcanization for achieving a complete detachable shoe.

The detachable zipper shoe made in accordance with the method in the second preferred embodiment has the following advantages:

1) There are six sets of marks drawn on every portion of the shoe; the marks are distributed on the front side, the back side, the left side, the right side, the start points, and the terminal points of the shoe. These six sets of marks avoid displacement resulted from inaccuracy. Favorably, the toe part could perfectly fit the shoe, which enhances the stability thereof.

2) The lower zipper is previously sewn to a piece of leather that is of high density, and then the composite lower zipper is further combined to the outsole via cement. Wherein, this combination prevents the cement from coming off, and there is no suture formed on the outsole to affect the using life of the shoe.

3) The lower zipper is previously sewn to a piece of leather that is of high density. Herein, the composite lower zipper could be firstly combined to the inner sole, rather than the outsole. After the vamp is shaped, the inner sole and the vamp are zipped up via the lower zipper and the upper zipper. Thereby, the combined inner sole and the vamp are subjected to heating for shaping. Namely, when the outsole is prevented from heating, a higher temperature could be adopted for forming the vamp. Whereby, the highly-heated vamp would be more stable and not deformable, which concurrently enhances the using life of the shoe.

I claim:

1. Method for manufacturing detachable zipper shoe comprising steps of:

preparing cardboards:

1) structuring a shoe last: said shoe last being structured in accordance with a design chart and a designate size of said detachable shoe;

2) making cardboards: vamp cardboards, an inner sole cardboard, and an outsole cardboard being made in accordance with said shoe last;

3) drawing arrays of marks for orientation: respectively drawing a plurality of marks aligned with each other on said vamp cardboards, said vamp cardboards, an upper zipper, a lower zipper, said inner sole cardboard, and said outsole cardboard;

making a vamp:

1) making a first cutting die: said first cutting die for cutting said vamp being made in accordance with said vamp cardboards;

2) cutting: vamp parts being cut out from an integral vamp material via said first cutting die;

3) drawing vamp marks on said vamp: correspondingly drawing a plurality of vamp marks on said vamp parts in accordance with said marks on said vamp cardboard, thereby drawing accordant sewing lines on each part of said vamp;

4) combining said vamp: combining every part of said vamp via said sewing lines for contributing to a complete vamp;

5) combining said vamp with said upper zipper: said complete vamp and said upper zipper being combined according to said vamp marks on said vamp and said marks on said upper zipper, thereby combining said vamp with said upper zipper;

making an outsole:

1) forming said outsole: said outsole being shaped in accordance with said outsole cardboard, and outsole marks being drawn on said outsole cardboard after said outsole is shaped;

2) combining said outsole and said lower zipper: said outsole being combined with said lower zipper in accordance with said outsole marks and said marks on said lower zipper after said outsole is shaped;

making an inner sole:

1) making a second cutting die: said second cutting die for cutting said inner sole being made in accordance with said inner sole cardboard;

2) cutting: an inner sole material being cut out via said second cutting die, and inner sole marks being drawn according to said inner sole cardboard so as to combine with said vamp;

3) combining said inner sole and said outsole: said inner sole being placed within a lining of said outsole, thereby allowing said inner sole and said outsole to be combined together by a cooperation of said outsole marks and said inner sole marks drawn on both of said innersole and said outsole;

fixing said vamp:

said complete vamp and said complete outsole combined with said inner sole being zipped up through said zippers, whereby said shoe last is slipped therein, and said vamp is further fixed through a cold vulcanizing and a hot vulcanizing; said shoe last being taken out after said vamp being fixed, and an insole being embedded into said vamp to complete a combination of an integral shoe and achieve a finished detachable shoe.

2. The method as claimed in claim 1, wherein, said marks correspondingly drawn on said cardboards and said upper and said lower zippers are distributed on four sides relevant to a front side, a back side, a left side, and a right side of said shoe, or are distributed on six sides including not only said four sides but start points and terminal points of said zippers.

3. The method as claimed in claim 1, wherein, said lower zipper and said outsole are combined via cementing; said outsole with said lower zipper are combined with said inner sole via a cold adhibiting method or vulcanization.

4. The method as claimed in claim 1, wherein, before combining said vamp or said soles, a set of main zippers of different sizes are provided with several marks according to said cardboards; by means of said main zipper, while zipping up said lower zipper and a main upper zipper of said main zipper of a same size, said marks on said lower zipper are able to be drawn according to said main upper zipper; while zipping up said upper zipper and a main lower zipper of said main zipper of a same size, said marks on said upper zipper are able to be drawn according to said main lower zipper.

5. Method for manufacturing detachable zipper shoe comprising steps of:

preparing cardboards:

1) structuring a shoe last: said shoe last being structured in accordance with a design chart and a designate size of said detachable shoe;

2) making cardboards: vamp cardboards, an inner sole cardboard, and an outsole cardboard being made in accordance with said shoe last;

3) drawing sets of marks for orientation: respectively drawing a plurality of marks aligned with each other on said vamp cardboards, an upper zipper, a lower zipper, said inner sole cardboard, and said outsole cardboard;

making a vamp:

1) making a first cutting die: said first cutting die for cutting said vamp being made in accordance with said vamp cardboards;

2) cutting: vamp parts being cut out from an integral vamp material via said first cutting die;

3) drawing vamp marks on said vamp: correspondingly drawing a plurality of vamp marks on said vamp parts in accordance with said marks on said vamp cardboard, thereby drawing accordant sewing lines on each part of said vamp;

4) combining said vamp: combining every part of said vamp via said sewing lines for contributing to a complete vamp;

making an inner sole:

1) making a second cutting die: said second cutting die for cutting said inner sole being made in accordance with said inner sole cardboard;

2) cutting: an inner sole material being cut out via said second cutting die, and inner sole marks being drawn on said inner sole cardboard so as to combine with said vamp;

making an outsole:

outsole marks being correspondingly drawn inside said outsole in time of making said outsole in a forming die, and after said outsole is shaped, a step for shaping said vamp ensuing;

combining said vamp, said inner sole, and said zipper:

1) combining said vamp and said upper zipper: said vamp marks on said vamp and said marks on said upper zipper being correspondingly disposed, allowing said vamp and said upper zipper to be combined;

2) combining said inner sole and said lower zipper: before combining said inner sole to said lower zipper, a piece of leather that is of high density being provided for joining to said lower zipper; after joining said leather to said lower zipper, said lower zipper being sewn to said inner sole via aligning said inner sole marks on said inner sole with said marks on said lower zipper;

3) combining said vamp and said inner sole: said vamp and said inner sole being combined through zipping up said upper zipper and said lower zipper;

fixing said vamp and combining to said outsole:

said vamp and said inner sole being combined, thereby slipping said shoe last to further fix said vamp through a cold vulcanizing and a hot vulcanizing; said fixed vamp being further combined to said outsole for achieving a complete detachable shoe.

6. The method as claimed in claim 5, wherein, in making said vamp, fixing marks are drawn on said first cutting die in accordance with said marks on said vamp cardboards, thereby allowing said vamp marks to be drawn on each part of said vamp according to said fixing marks on said first cutting die while cutting.

7. The method as claimed in claim 5, wherein, said marks correspondingly drawn on said cardboards and said upper and said lower zippers are distributed on four sides relevant to a front side, a back side, a left side, and a right side of said shoe, or are distributed on six sides including not only said four sides but start points and terminal points of said zippers.

8. The method as claimed in claim 5, wherein, said outsole combined with said zippers and said inner sole are further joined via a cold adhibiting method or vulcanization.

9. The method as claimed in claim 5, wherein, said vamp is formed in accordance with a main plate that is reversely made by said vamp formed via a combination of said vamp cardboards and drawn with said vamp marks.

10. The method as claimed in claim 5, wherein, said upper zipper and said lower zipper are formed in accordance with a main zipper, which is drawn with a plurality of marks in different sizes according to marks on a main plate of said vamp; thereby allowing several main zippers of different sizes to be formed; while zipping up said lower zipper and a main upper zipper of said main zipper of a same size, said marks on said lower zipper are able to be drawn according to said main upper zipper; while zipping up said upper zipper and a main lower zipper of a same size, said marks on said upper zipper are able to be drawn according to said main lower zipper.

* * * * *